United States Patent [19]

Johnson

[11] 4,124,312

[45] Nov. 7, 1978

[54] IMPACT PRINTER WITH PRINT WHEEL CARTRIDGE

[75] Inventor: Robert A. Johnson, Plano, Tex.

[73] Assignee: Xerox Corporation, Stamford, Conn.

[21] Appl. No.: 767,249

[22] Filed: Feb. 10, 1977

[51] Int. Cl.[2] ..... B41J 1/30

[52] U.S. Cl. ..... 400/144.2; 400/320

[58] Field of Search ..... 101/93.15, 93.16, 93.17, 101/111; 197/18, 49, 52–54, 82; 206/444

[56] References Cited

U.S. PATENT DOCUMENTS

| | | | |
|---|---|---|---|
| 3,772,988 | 11/1973 | Bowers, Jr. et al. | 101/111 |
| 3,774,531 | 11/1973 | Hansen et al. | 101/111 X |
| 3,858,509 | 1/1975 | Grundherr | 197/54 X |
| 3,892,303 | 7/1975 | Willcox | 197/53 X |
| 3,991,873 | 11/1976 | Paulson et al. | 197/53 |
| 4,026,403 | 5/1977 | Inose et al. | 197/18 X |

*Primary Examiner*—Paul T. Sewell

*Attorney, Agent, or Firm*—Sheldon F. Raizes

[57] ABSTRACT

An impact printer is provided with an easy load print wheel mechanism. A print wheel cartridge, containing a print wheel therein, is inserted into a print wheel loaded position and removed therefrom without disturbing the position of a print wheel drive motor or ribbon cartridge. The print wheel drive motor shaft is automatically coupled to the print wheel within the cartridge upon insertion of the cartridge into print wheel loaded position.

11 Claims, 5 Drawing Figures

IMPACT PRINTER WITH PRINT WHEEL CARTRIDGE

DESCRIPTION OF THE INVENTION

On current impact printers utilizing a rotatable print wheel, such as the "Xerox 800," a motor, hammer mechanism and ribbon cartridge are supported on a frame which is pivotably mounted on a moving carriage. The frame must be pivoted from a print position in order to replace the print wheel.

Due to interfering structure, the ribbon cartridge must be removed to allow pivoting of the frame. It is desirable to protect the print wheel during handling and storage and to replace the print wheel with as simple a procedure as possible. It is also desirable to eliminate direct handling of a used print wheel when replacing the same to prevent an operator from accidentally getting ink on his hands or clothing.

Accordingly, it is an object of this invention to provide a printer with an easy load print wheel apparatus.

A further object of the invention is to provide a print wheel cartridge which can be used in the easy load print wheel apparatus on the printer.

Another object of the invention is to provide a printer with a simple print wheel cartridge loading and unloading mechanism, wherein an operator handles only the cartridge and does not have to directly contact the print wheel.

Other objects of the invention will become apparent from the following description with reference to the drawings wherein.

Figure 1:
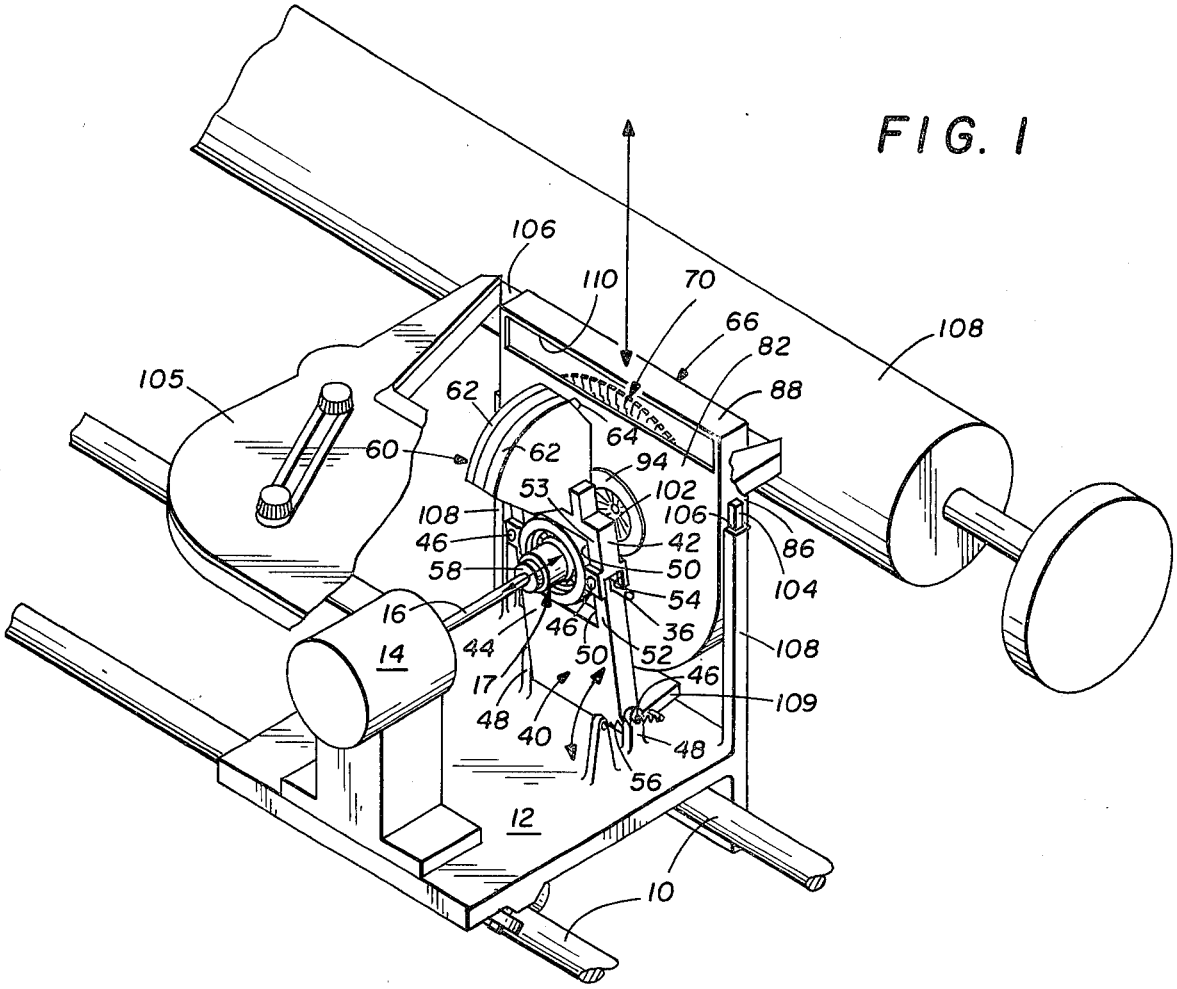
FIG. 1 is a simplified perspective view of a printer carriage and platen.
Figure 2:
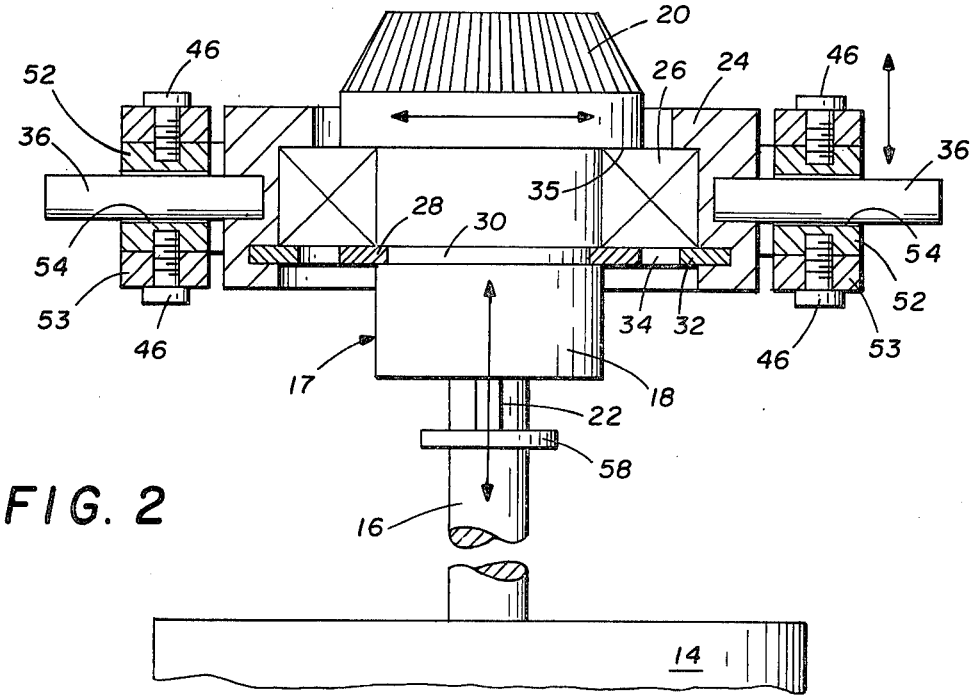
FIG. 2 is a partial plan view of a motor, drive shaft, drive element and the connection thereof to a lever, the connection being shown in section.

Referring to FIGS. 1 and 2, there is shown a simplified view of a printer sub-assembly. A pair of guide rails 10 slidably support a carriage 12 thereon. Mounted on the carriage is a print wheel drive motor 14 which drives a rotatable shaft 16. A print wheel drive element 17 comprising a cylindrical sleeve 18 and a knurled cone-shaped coupling head 20 is mounted on the shaft 16 by splines 22 which permits slidable axial movement of the drive element 17 on the shaft 16 while effecting a rotational drive coupling therebetween.

An annular housing 24 surrounds the sleeve 18 and a bearing race 26 is confined between the housing 24 and sleeve 18 to provide a rotatable connection between the housing 24 and the print wheel drive element 17. A snap ring 28 is located in a groove 30 on the sleeve 18 and a snap ring 32 is located in a groove 34 on the housing 24 to retain the bearing 26 in place on the housing. The knurled head 20 has an enlarged shoulder 35 engaging the bearing 26 which, together with snap ring 28, connects the print wheel drive element 17 to the housing 24 for lateral movement therewith. A pair of laterally spaced studs 36 are located 180° apart on the housing 24.

Figure 3:
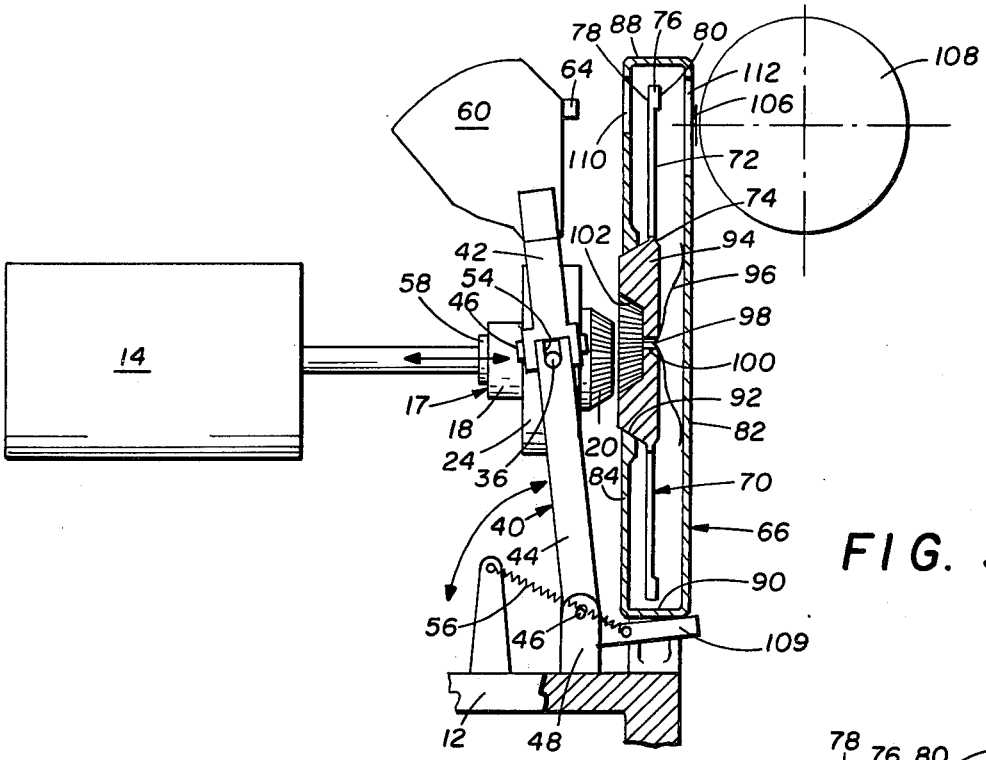
FIG. 3 is a side view of FIG. 1, only a print wheel cartridge is shown in section in a print wheel loading position.
Figure 4:
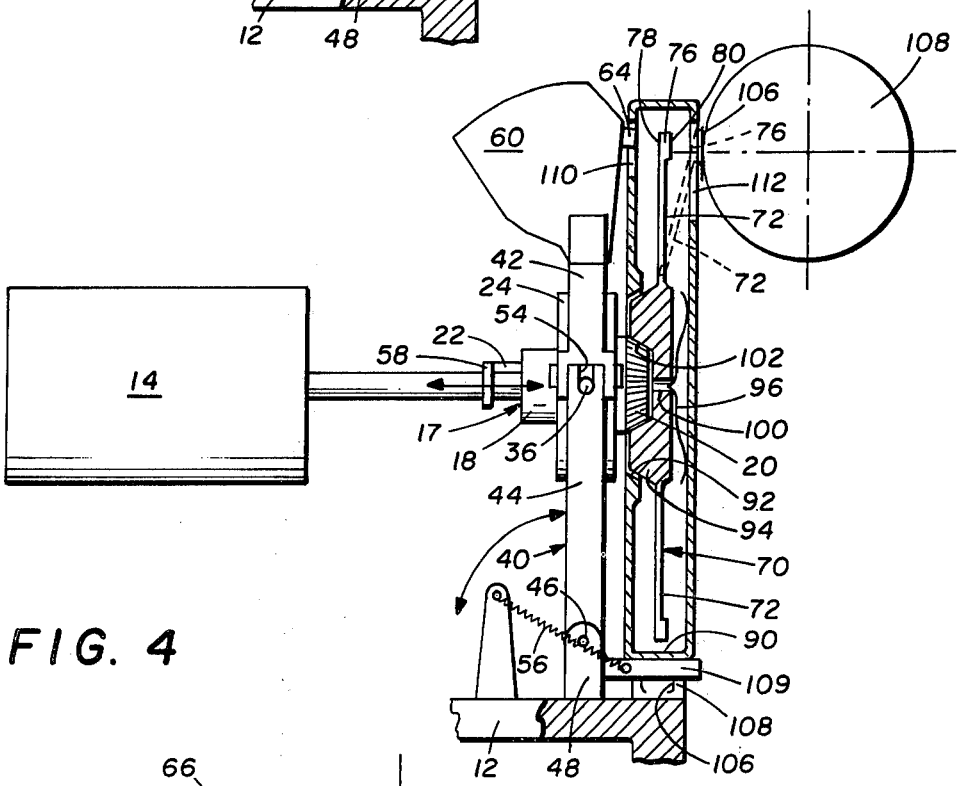
FIG. 4 is a view similar to FIG. 3, only showing the print wheel cartridge in loaded position.

Referring to FIGS. 1, 3 and 4, a lever 40 comprises a top section 42 and bottom section 44 secured together by screws 47. The bottom section 44 is "L" shaped and is rotatably secured to the carriage 12 by a pin 46 which passes through a pair of upstanding ears 48 on the carriage and through the bottom section 44. The upper end of the bottom section 44 and the lower end of the upper section 42 are generally U-shaped with an elongated opening 50 formed between the legs 52 and 53 of each section, respectively. The legs 52 each have an open ended slot 54 forming a U-shaped portion which is perpendicular to the U-shape formed by both legs. The legs 53 are each bifurcated to straddle a respective one of the legs 52 to which they are secured by screws 46. When the sections are secured together, a closed elongated opening 50 and closed elongated slot 54 are formed. The shaft 16, the print wheel drive element 17 and the housing 24 extend through the opening 50 with the studs 36 extending through a respective one of the elongated slots 54. Pivotal movement of the lever 40 is translated into axial shifting of the housing 24 and thereby the drive element 17, since the studs 36 can slide in the slots 54. Thus, the drive element 17 is rotatable relative to the lever 40 but is connected thereto to be moved axially on the shaft 16 upon pivoting thereof.

An over-the-center spring 56 is attached at one end to the carriage 12 and at the other end to the lever 40 and is so arranged that in a cartridge loading or cartridge unloaded position the spring force acts on the lever 40 to urge the same in a counter-clockwise direction about pivot pin 46. (See FIG. 3). A flange 58 on the shaft 16 limits movement of the drive element 17 by the lever 40 in the counter-clockwise direction and thus acts as a stop when the lever is pivoted counter-clockwise.

A moving coil hammer mechanism 60 is secured to the upper section 42 and comprises a pair of opposing permanent magnets 62 with a swinging hammer 64 therebetween. The hammer has a coil of magnetic wire (not shown) wrapped thereon. When current is passed through the coil the magnetic field generated results in the hammer being thrust forward. For a more detailed explanation of the operation and mechanism of such a hammer, reference is made to U.S. Pat. Nos. 3,279,362 and 3,279,364, which are hereby incorporated herein by reference.

A print wheel cartridge 66 contains a print wheel 70 therein. The print wheel 70 comprises a plurality of spokes 72 radially extending from an annular portion 74. At the other end of each spoke is secured a character pad 76 having a hammer impact face 78 and a print face 80 on which a character is formed. The cartridge 66 has a front wall 82 and a rear wall 84 joined by side walls 86 (FIG. 1), a top wall 88 and a bottom wall 90. The rear wall has a thickened portion with a frusta-conical opening 92 therein. A cup shaped spring 96, which is supported on its periphery on the front wall 82, has a conical point 98 at the closed end thereof projecting into a small opening 100 on the print wheel to provide essentially a point contact therebetween for low friction rotation of the print wheel about the spring 96. The print wheel has a frusta-conical hub 94 at the center thereof which is complimentary to and projects into the frusta-conical opening 92 of the rear wall 84. The spring 96 biases the print wheel 70 towards the rear wall 84 until the complimentary frusta-conical edge of the hub 94 and of the opening 92 contact each other. The hub also has a frusta-conical shaped recess 102 for receiving the knurled coupling head 20 therein. The complimentary edges of the hub 94 and of the opening 92 serve to locate the recess 102 in the approximate center of the opening 92. A pair of laterally spaced ears 104 (FIG. 1) extend outwardly from each sidewall 86 and are receivable in a respective one of the grooves 106 of a pair of laterally spaced guide members 108 secured to and extending upwards from the carriage 12.

Referring to FIG. 4, upon insertion of ears 104 of the cartridge 66 into the guides 108 and moving the cartridge downwards, the bottom wall 90 of the cartridge will strike arm 109 of the lever 40 effecting clockwise rotation thereof thereby causing the drive element 17 to slide axially on shaft 16 to bring knurled coupling end 20 into contact with the hub recess 102. Over center spring 56 is of such strength to effect a clockwise rotational force on the lever 40 to the extent that drive element 17 will force the print wheel hub 94 away from contact with the edge of opening 92 against the force of cup spring 96 to permit the print wheel to rotate within the cartridge 66. The surface of the recess 102 is such that a driving relationship is effected between the knurled coupling end 20 and the surface of recess 102 whereby the print wheel is driven by motor 14.

A ribbon cartridge 105 (only partially shown for clarity of the other elements) is supported on platform 107 secured to the carriage 12. The ribbon cartridge carries a ribbon supply spool (not shown) and a driven ribbon takeup spool (not shown) which transfers a fresh portion of an inked ribbon 106 across a printing station between the print wheel cartridge 66 and a platen 108. For simplicity, the ribbon driving mechanism is not shown, but it should be understood that the ribbon cartridge and drive mechanism can be of any well known construction.

Figure 5:
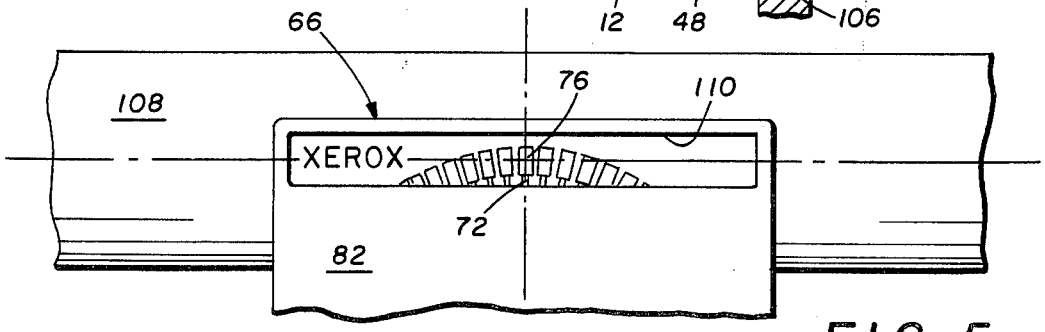
FIG. 5 is a rear view of the upper portion of the print wheel cartridge and the platen.

A rectangular opening 110 is in the upper portion of the rear wall 84 and a rectangular opening 112 is in the upper portion of the front wall 82. The character pads 76 of the print wheel rotate past the rectangular openings at the printing station and are struck by the hammer 64 which projects through the opening 110 when activated. Upon impact of the hammer with a character pad, the respective spoke 72 will bend and the pad will project through the opening 112 in the front wall and strike the ribbon 106 and thereafter a sheet of paper (not shown) on the platen 108. The ribbon 106 is lifted into the path of a character pad during a printing mode and lowered thereafter so an operator can observe the previous character struck. The openings 110 and 112 also serve as a window through which the characters can be viewed, as illustrated in FIG. 5.

The center of recess 102 does not have to be exactly aligned with the axis of the shaft 16 when contact is made by the knurled end 20 with the wall of recess 102, since axial movement of the frustum shaped knurled end 20 will result in a camming action on the wall of the recess 102 to center the same on the knurled end 20. Therefore, the tolerances on the location of the hub 94 in the opening 92 can be quite loose. Also, it is not necessary that the end 20 and the recess 102 be substantially aligned with each other when the print wheel cartridge 66 initially engages the arm 109. All that is necessary is that the recess 102 be sufficiently adjacent to the end 20 that the end 20 and recess 102 will become aligned during the final movement of end 20 into engagement with the recess 102. For instance, the unloaded position for lever 40 could be such that the relative position of the print wheel cartridge and end 20, as shown in FIG. 3, would be significantly after initial engagement by the cartridge 66 with arm 109 of the lever 40.

To remove the print wheel cartridge, the hammer mechanism can be pulled backwards causing rotation of the lever 40 in a counter-clockwise direction and thereby stretching the over-center spring 56 until the force thereof changes to the other side of the pivot 46. The spring 56 then induces a counter-clockwise rotational force on the lever 40 and urges the drive element 17 against the stop 58. As the lever is rotated in a counter-clockwise direction, the knurled drive end 20 is removed from recess 102, the arm 109 engages the bottom wall 90 of the cartridge and moves the same upwards on the guides 108 to a position where the cartridge can be readily grasped by the operator and removed.

It should be understood that the cartridge 66 need not be an enclosed structure as shown, but could be any type of supporting structure for a print wheel; the important feature being that the cartridge protects the print wheel, provides a structure which can be handled by an operator, and provides a structure which can be guided into operative position on the printer.

From the above description, one can readily see that the instant invention provides a printer with an easy load print wheel mechanism wherein the print wheel does not have to be directly handled, and the position of the ribbon cartridge and print wheel drive motor does not have to be disturbed.

What is claimed is:

1. In an impact printer for use with a print wheel cartridge: A movable carriage, a motor supported by said carriage, a rotatable shaft extending from said motor and having coupling means at one end thereof, said carriage having guide means supported thereon for slidably receiving the cartridge therein, said shaft being rotatable relative to said guide means, said guide means being arranged for guiding the cartridge for slidable movement in a direction generally transverse to the axis of rotation of said shaft, and movable means actuatable by the cartridge during movement thereof in the transverse direction for effecting relative movement between said coupling means and the cartridge in a different direction than said transverse direction toward each other to a print wheel loaded position.

2. The structure as recited in claim 1 further comprising a print hammer mechanism, means for pivotally mounting said print hammer mechanism to said carriage so as to provide for pivotal movement relative to the cartridge out of the path of the cartridge when the cartridge is inserted into said guide means.

3. The structure as recited in claim 1 said means for effecting relative movement between said coupling means and the cartridge towards each other including lever means operatively connected to said coupling means, said coupling means being movable, said lever means being located in the path of the cartridge when the cartridge is guided by said guide means, said lever means being so disposed to effect said relative movement between said coupling means and the cartridge towards each other by moving said coupling means when said lever means is engaged by the cartridge.

4. The structure as recited in claim 3 further comprising a print hammer mechanism, said hammer mechanism being mounted on said lever means for movement therewith relative to the cartridge out of the path of the cartridge when it is inserted into said guide means.

5. In an impact printer: a movable carriage, a motor supported by said carriage, a rotatable shaft extending from said motor and having coupling means at one end thereof, a cartridge, a print wheel, means for rotatably supporting said print wheel on said cartridge so that said print wheel is rotatable about a given axis relative to said cartridge, said print wheel having cooperating means engageable with said coupling means in such a manner that said print wheel is driven by said shaft, said carriage having guide means supported thereon for slidably receiving said cartridge therein, said shaft being rotatable relative to said guide means, said guide means being arranged for guiding said cartridge for slidable movement in a direction generally transverse to the axis of rotation of said shaft to a position where said coupling means is generally adjacent to said cooperating means, and movable means actuatable by said cartridge during movement thereof in the transverse direction for effecting relative movement between said coupling means and said cartridge in a different direction than said transverse direction toward each other to connect said coupling means with said cooperating means in a print wheel loaded position.

6. The structure as recited in claim 5 further comprising: said print wheel having a plurality of spokes extending radially outwards from a center portion, each of said strokes having a character pad at the outer end thereof, each character pad having a hammer impact face and a print face, said cartridge having at least one wall extending generally parallel to the said spokes, an opening in said wall exposing said cooperating means, biasing means operatively connected to said print wheel and said cartridge to bias said print wheel in an axial direction toward said wall, said cartridge being arranged to expose at a print station at least the hammer impact area and the print face of at least one character pad, said coupling means extending through said opening into engagement with said cooperating means in said print wheel loaded position, said coupling means moving said print wheel in an axial direction away from said wall against the force of said biasing means when brought into engagement with said cooperating means.

7. The structure as recited in claim 6 wherein said biasing means has a portion thereof engaging a center portion of said print wheel which is aligned with the axis of rotation thereof, said center portion of said print wheel and said portion of said biasing means being relatively rotatable.

8. The structure as recited in claim 6 further comprising a print hammer mechanism adjacent the print station, said print hammer mechanism including a print hammer arranged to strike the exposed hammer impact face, means for pivotally mounting said print hammer mechanism to said carriage so as to provide for pivotal movement relative to said cartridge and print wheel out of the path of said cartridge when said cartridge is inserted into said guide means.

9. The structure as recited in claim 6: said means for effecting relative movement between said coupling means and said cartridge including lever means operatively connected to said coupling means, said coupling means being movable, said cartridge having lever engaging means thereon, said lever means being located in the path of said lever engaging means when said cartridge is guided by said guide means towards said position where said drive means is generally adjacent to said cooperating means, said lever means being so disposed to effect said movement between said coupling means and said cartridge toward each other by moving said coupling means when said lever means is engaged by said lever engaging means.

10. The structure as recited in claim 9 further comprising a print hammer mechanism adjacent the print station, said print hammer mechanism including a print hammer arranged to strike the exposed hammer impact face, said hammer mechanism being mounted on said lever for movement therewith relative to said cartridge out of the path of said cartridge when cartridge is inserted into said guide means.

11. A method of assembling a print wheel to a rotatable motor shaft of a printer; taking a print wheel cartridge and inserting the print wheel cartridge into guide means separate from the rotatable shaft and supported on a movable carriage and slidably moving the movable cartridge on the guide means between a printer platen and drive coupling means on a motor shaft in a direction generally transverse to the axis of rotation of the shaft to bring cooperating means of a print wheel within the cartridge to a position generally adjacent to the drive coupling means and to engage the cartridge with a means to thereafter operatively effect relative movement between said drive coupling means and said cooperating means in a different direction than said transverse direction toward each other to connect the drive coupling means and the cooperating means with each other.

* * * * *